US005386099A

United States Patent [19]

Has

[11] Patent Number: 5,386,099

[45] Date of Patent: Jan. 31, 1995

[54] SELF-CLEANING PROCESS UTILIZING FUZZY LOGIC AND STOVE FOR CARRYING OUT THE PROCESS

[75] Inventor: Uwe Has, Schwindegg, Germany

[73] Assignee: Bosch-Siemens Hausgeraete GmbH, Munich, Germany

[21] Appl. No.: 93,387

[22] Filed: Jul. 19, 1993

[30] Foreign Application Priority Data

Jul. 17, 1992 [DE] Germany ..... 4223656

[51] Int. Cl.[6] ..... F24C 14/02

[52] U.S. Cl. ..... 219/413; 134/1; 134/18; 126/273 R; 395/900

[58] Field of Search ..... 219/413, 414, 509, 492; 134/1, 18, 19; 126/273 R, 19 R, 275 E; 99/451; 395/900

[56] References Cited

U.S. PATENT DOCUMENTS

| | | | |
|---|---|---|---|
| 4,904,849 | 2/1990 | Sinn | 219/413 |
| 4,908,760 | 3/1990 | Sinn | 219/413 |
| 5,083,010 | 1/1992 | Henry et al. | 219/413 |
| 5,286,943 | 2/1994 | Has | 219/413 |

FOREIGN PATENT DOCUMENTS

| | | |
|---|---|---|
| 2166227 | 5/1973 | Germany . |
| 2310290 | 9/1974 | Germany . |

*Primary Examiner*—Bruce A. Reynolds

*Assistant Examiner*—John A. Jeffery

*Attorney, Agent, or Firm*—Herbert L. Lerner; Laurence A. Greenberg

[57] ABSTRACT

A pyrolytic self-cleaning stove includes at least one wall region defining an oven chamber, a muffle disposed in the at least one wall region, a heating element with additional ambient air heating for operating the muffle, an ambient air blower for ventilating the muffle, a device associated with the muffle for pyrolytic self-cleaning, and a sensor array disposed in the cooking chamber for detecting oven soiling values caused by operation. A pyrolytic self-cleaning method for stoves includes on-line optimization of a definable pyrolysis temperature range up to approximately 500° C. by fuzzy-controlling a transient state for a temperature starting value with a regulating device, to avoid a heating startup peak with a fuzzy control step; recognizing subsiding of the transient state and initializing an optimized heating time referred to the fuzzy control step, with the regulating device; updating a minimum heating time for the next control step on the basis of the particular temperature gradient being recognized, while constantly monitoring the optimal turn-on temperature for the pyrolytic oven chamber heating, with the regulating device, at a minimum heating time referred to an applicable control step; and continuously optimizing the turn-off temperature with the regulating device, through a closed control loop.

17 Claims, 3 Drawing Sheets

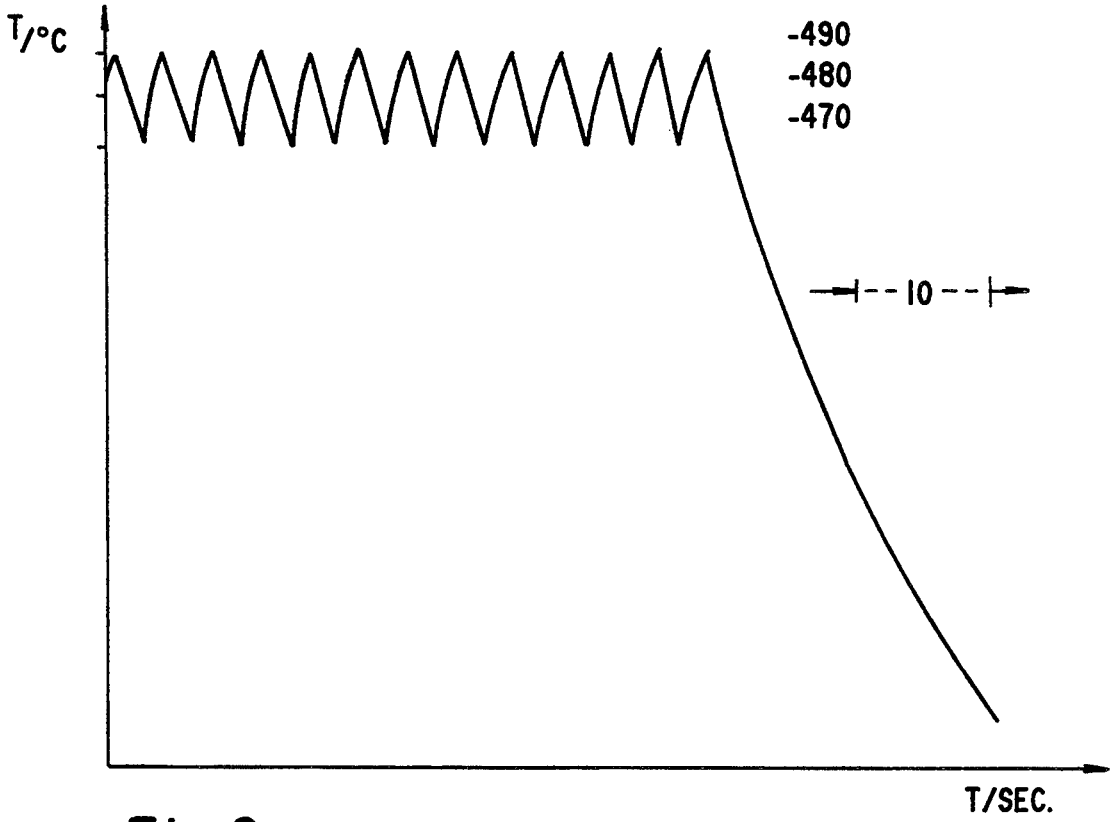
Fig.2
Fig.4
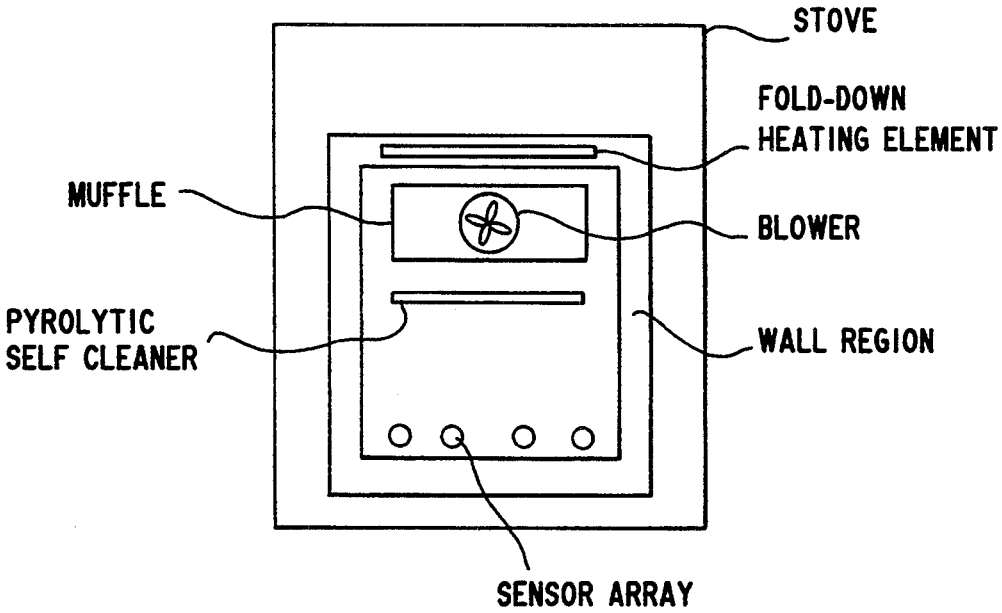

SELF-CLEANING PROCESS UTILIZING FUZZY LOGIC AND STOVE FOR CARRYING OUT THE PROCESS

BACKGROUND OF THE INVENTION

FIELD OF THE INVENTION

The invention relates to a pyrolytic self-cleaning process for stoves having a muffle being operable by means of a fold-down heating element disposed in at least one wall region and having additional ambient air heating, the muffle being ventilatable by an ambient air blower and being equipped with means for pyrolytic self-cleaning, and a sensor array disposed in the cooking chamber for detecting oven soiling values being dictated by operation.

German Patents DE-PS 21 66 227 and 23 10 290 disclose stove muffles with means for pyrolytic self cleaning. The point of departure there is that for pyrolytic self-cleaning, mean oven temperatures above 500° C. must be employed to achieve satisfactory self-cleaning effects. Temperatures of approximately 500° C. are maintained for a certain period of time, and this period corresponds to a value ascertained by trial and error, rather than reproducing the actual conditions of muffle soiling.

However, more recent tests have confirmed that temperatures of approximately 450° C. in the center of the oven have an adequate pyrolytic self-cleaning effect. The relatively long-chained molecules of the soiling adhering to the walls of the muffle are subjected to thermal cracking by long-persisting heating to above 450° C., and thus are converted into relatively short-chained products of decomposition, such as water, short hydrocarbons, aromatics, and ash residues. The gaseous products of decomposition are removed from the stove by venting during the self-cleaning. Once the self-cleaning is completed, the remaining residues, in the form of ash, can be removed from the stove. Along the way to 450° C. at the center of the oven, temperature ranges are traversed that promote increased carbon monoxide development. Such toxic, unwelcome gas may be considered harmless for temperatures above 450° C. in terms of its concentration that is capable of escaping to the outside. Many manufacturers have therefore attempted to perform heating as quickly as possible to a temperature above 450° C. in the muffle and to start the long-term pyrolysis process only after that. On the other hand, experiments have shown that valuable enamel in stoves of the upper price category, for which self-cleaning processes are offered, is involved to the point of destruction by the action of heat at approximately 500° C.

SUMMARY OF THE INVENTION

It is accordingly an object of the invention to provide a self-cleaning process for stoves and a self-cleaning stove for carrying out the process, which overcome the hereinafore-mentioned disadvantages of the heretofore-known methods and devices of this general type and which provide a pyrolysis process that operates with a virtually constant final pyrolysis temperature of approximately 480° C., so that the enamel temperature is also below 500° C.

With the foregoing and other objects in view there is provided, in accordance with the invention, a pyrolytic self-cleaning method for stoves and a stove for carrying out the method, comprising at least one wall region defining an oven chamber, a muffle disposed in the at least one wall region, a heating element with additional ambient air heating for operating the muffle, an ambient air blower for ventilating the muffle, means associated with the muffle for pyrolytic self-cleaning, and a sensor array disposed in the cooking chamber for detecting values of oven soiling caused by operation, in which for on-line optimization of a definable pyrolysis temperature range up to approximately 500° C.; a regulating device fuzzy-controls a transient state for a temperature starting value, so that a heating startup peak is already avoided with a fuzzy control step; the regulating device recognizes the dying out or subsiding of the transient state and initializes an optimized heating time referred to the first fuzzy control step; at a minimum heating time referred to the applicable control step, the regulating device, while constantly monitoring the optimal turn-on temperature for the pyrolytic cooking chamber heating, updates the minimum heating time for the next control step on the basis of the particular temperature gradient recognized; and the regulating device optimizes the turn-off temperature continuously, through a closed control loop.

In accordance with another feature of the invention, there is provided a selector circuit connected to a fuzzy control block, the fuzzy control block corresponding with a central control turning the heat on or off depending on the transient state of the temperature starting value.

In accordance with a further feature of the invention, there is provided a unit connected to the central control for recognizing a temperature/time function and carrying out a recognition of a maximum stove temperature in cooperation with the unit.

In accordance with an added feature of the invention, there is provided a time counter being connected to the central control and having an output side, a heating timer being connected to the output side of the time counter and having an output side, and the output side of the heating timer being connected to the the central control for optimizing a turn-off temperature and correlating it with a minimum heating time in signal interaction.

In accordance with an additional feature of the invention, the central control is a microprocessor.

In accordance with yet another feature of the invention, there is provided an output unit connected to an output side of the central control for turning on cooking chamber heating.

In accordance with yet a further feature of the invention, there is provided an output unit connected to an output side of the central control for turning off cooking chamber heating.

In accordance with a concomitant feature of the invention, there is provided a display unit being activated by the central control for signalling pyrolytic self-cleaning during the duration of the self-cleaning.

Other features which are considered as characteristic for the invention are set forth in the appended claims.

Although the invention is illustrated and described herein as embodied in a self-cleaning process for stoves and a self-cleaning stove for carrying out the process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a temperature/time diagram for the temperature regulation;

FIG. 4 is a diagrammatic front view of a stove according to the invention.

DESCRIPTION OF THE PREFERRED EMBODIMENTS

Figure 1:
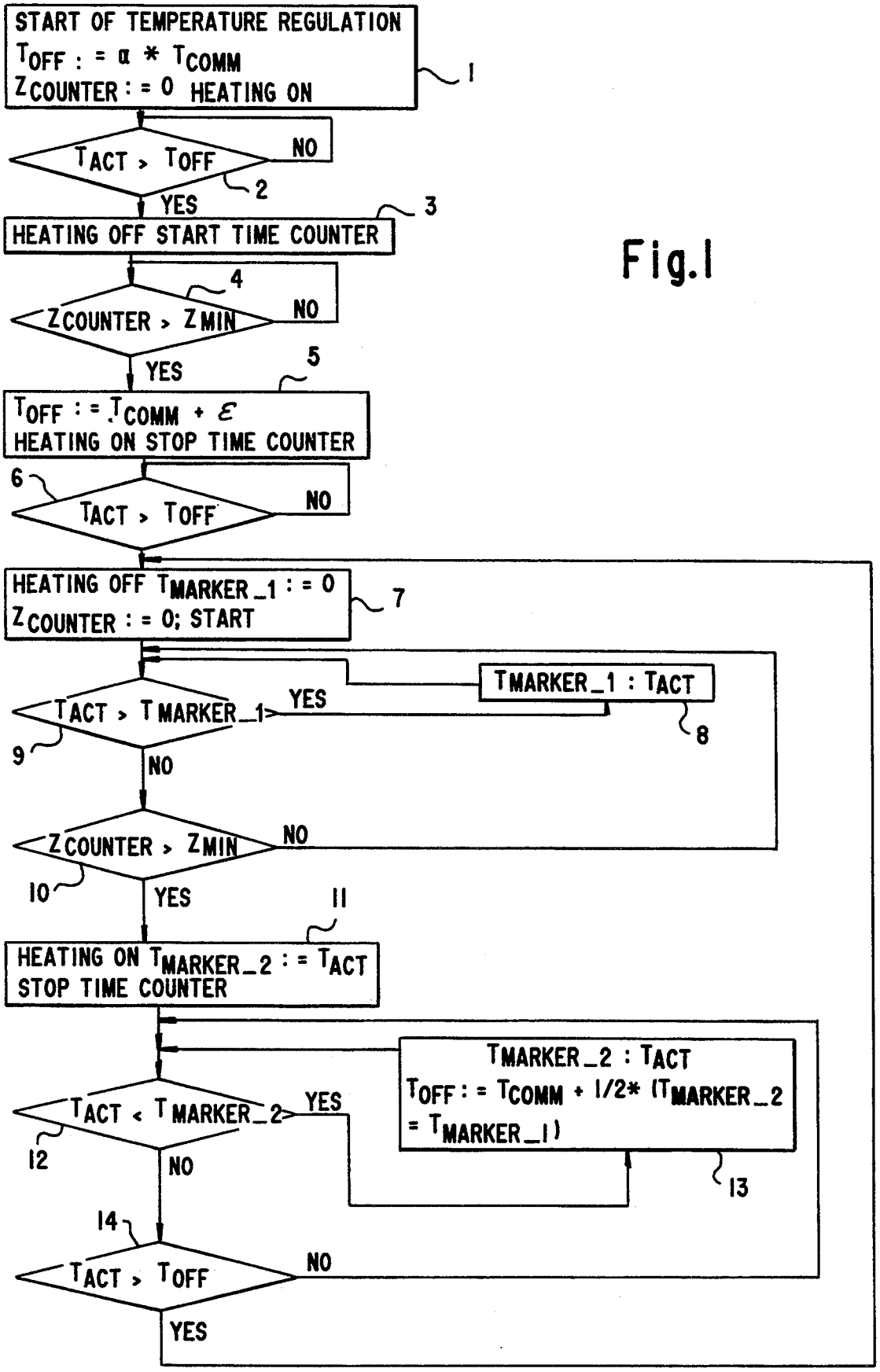
FIG. 1 is a flow chart showing method steps for temperature regulation for pyrolytic self-cleaning.

Referring now to the figures of the drawing in detail and first particularly to FIG. 1 thereof, there are seen method steps 1 through 14 for on-line optimizing of a fixable pyrolysis temperature range of up to approximately 500° C. for a pyrolytic self-cleaning process. In order to comprehend the method steps 1–14 described below, the following definitions are used:

Abbreviations for temperatures ($T_{xxx}$):

- $T_{comm}$=temperature at which the stove should be kept (pyrolysis temperature).
- $T_{act}$=temperature that currently prevails in the stove, as measured by a temperature sensor.
- $T_{on}$=temperature at which the temperature regulation turns on the stove heating. $T_{on}$ is self-generated during operation.
- $T_{off}$=temperature at which the temperature regulation turns off the stove heating.
- $T_{marker\text{-}1}$=marker for temperatures. This marker is needed for on-line optimization of the turn-off temperature $T_{off}$ of the heating.
- $T_{marker\text{-}2}$=marker for temperatures. This marker is needed for on-line optimization of the turn-off temperature $T_{off}$ of the heating.

Abbreviations for times ($Z_{xxx}$)

- $Z_{min}$=minimum time during which the stove is allowed to be minimally heated. It is specified (as a crack rate) by the electrical connection value of the stove heating. $Z_{min}$ is also the time for which the heating of the stove in cycling must at minimum be shutoff.
- $Z_{counter}$=time counter with which the minimum-on time of the heating is monitored. After being set to zero, this counter starts up by itself.

Remarks

Adapting $Z_{min}$ to local given conditions (properties of the stove resulting from variations in production, changes in mains voltage, etc.) is not expected to be very productive and therefore is not discussed.

Constants $\alpha$ and $\epsilon$ will best be ascertained by trial and error. If the temperature sensor is sufficiently fast, then explicit avoidance of the first overswitch (by the constant $\alpha$) is unnecessary.

According to FIG. 1, in a method step 1, the temperature regulation is not started until a temperature range of approximately 450° C. has been attained. The temperature ranges from room temperature to 450° C., for example, must be run through as fast as possible by all of the available heaters in the cooking chamber, to enable minimizing the production of CO gas, for instance. Once the temperature regulation has been started, then through the method steps 1, 2, 3 and 4, severe overswinging of the temperature beyond 490° C. is prevented. With the method steps 4 and 5, better adaptation of the first temperature course rise is attained. The method steps 6, 7, 8, 9 and 10 effect a transitional behavior for optimizing the turn-off temperature point. With the method steps 11, 12, 13 and 14, a closed control loop is attained, as a result of which on-line optimization of the turn-off point can be performed. Through the use of the method steps 1–14 of FIG. 1, a regulating curve and a circuit corresponding to FIGS. 2 and 3 can be inferred.

FIG. 2 shows a temperature plotter curve that represents the temperature course at the center of gravity of the stove. It must be understood in this context that a stove may include a range or it may only have an oven. The method steps 11–14, in particular, are shown in the graph from the standpoint of control technology. It can be seen that around the mean temperature of 480° C., the regulation makes a temperature constancy of plus or minus 10° C. possible. From FIG. 2, the turn-off point and the attendant temperature drop curve can also be inferred.

Figure 3:
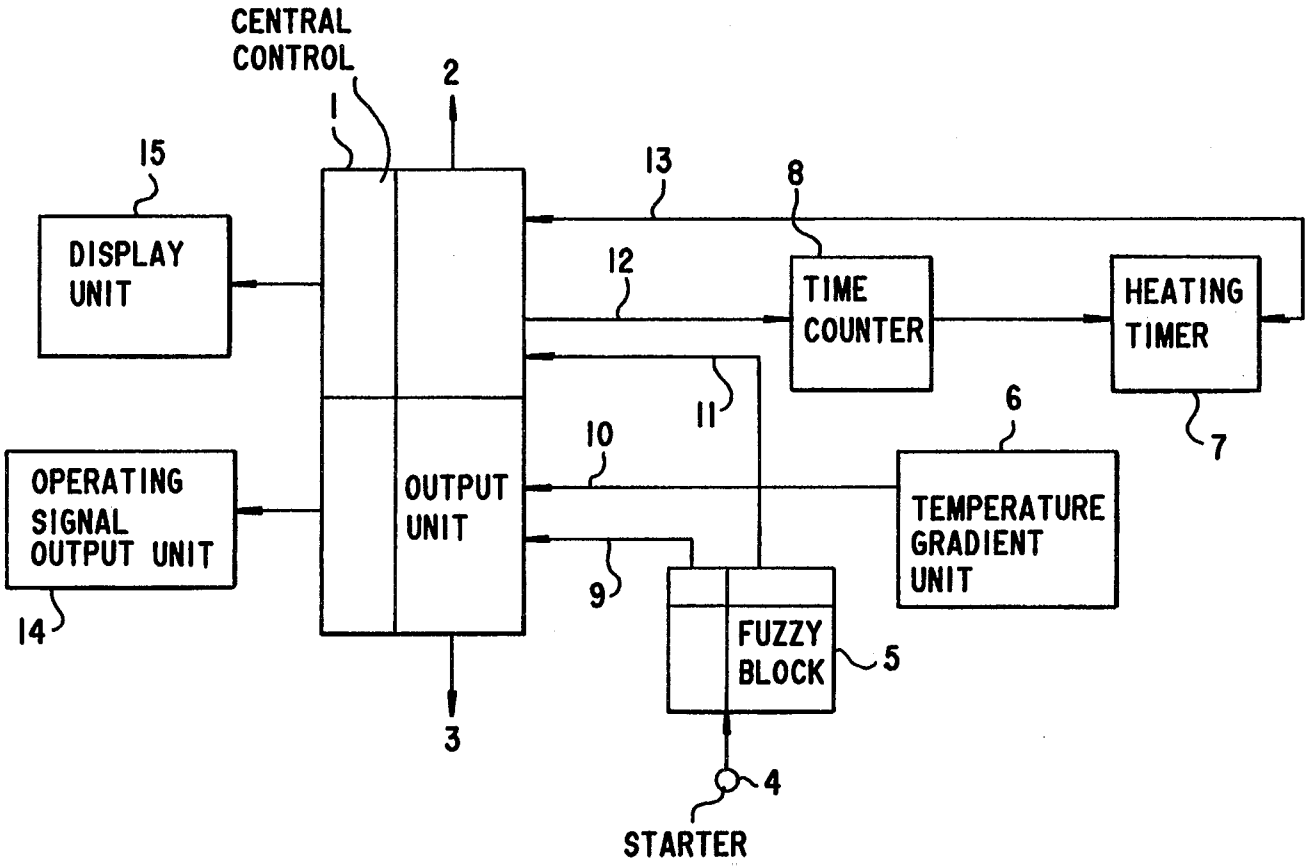
FIG. 3 is a schematic diagram of a circuit configuration according to the invention.

The circuit configuration of the invention is shown in FIG. 3. The basic circuit for on-line optimization of a pyrolysis temperature range up to approximately 500° C. includes a central control 1, an output unit 2 for turning on the heating, an output unit 3 for turning off the heating, a starter or selector circuit 4 for temperature regulation, a fuzzy block 5, a temperature gradient unit 6, a heating timer 7, a time counter 8, input lines 9, 10, 11, 13 for the central control, an output line 12 for the time counter, an operating signal output unit 14, and a display unit 15 for output data. The basic circuit shown in FIG. 3 is set into operation by the starting signal unit or starter 4 and is fuzzy-controlled by the fuzzy block 5 in combination with the central control 1, in the course of which the otherwise unavoidable peaks in starting up heating are cancelled out. The fuzzy block 5 has an empirical table and is connected on the output side to the central control 1 through the lines 9 and 11. As a result of the data content of the fuzzy block 5, the central control 1 activates the output unit 2, which then heats the cooking chamber for an estimated period of time to a pyrolysis temperature of $T_{comm}+\epsilon$. After that, the output unit 3 of the central control 1 turns the heating off. Once the heating has been turned on again a second time, the heating time counter 8 is simultaneously started and it is operated continuously through the central control 1, each time with heating times being updated for the next heating period. Upon the end of the second heating time cycle, the heating timer 7 sends a heating time that is close to the minimum necessary heating time over the bus line 13 to the central control 1. The minimum necessary heating time $T_{min}$ correlates with the recognition of the temperature course exceeding the command temperature. The temperature gradient unit 6 sends this information to the central control 1 over the bus line 10. After at least one but at most three fuzzy control steps, the central control 1 possesses the supplies of values relating to the turn-on temperature $T_{on}$, the minimum temperature increase $T_{min}$, and the temperature data $T_{off}$ at which the temperature regulation turns off the stove heating.

The central control also has data available on the minimum time during which the stove must be heated at a minimum, as well as updated data of the time counter, with which the minimum turn-on time of the heating is monitored. The turn-off time $T_{off}$, which is critical in this pyrolytic self-cleaning method, must be selected in the regulating method in such a way that for whichever enamel layer is present, the optimized pyrolysis temperature for its service life is not exceeded. In this particular case, a turn-off temperature of 490° C. has been assumed. The basic circuit shown in FIG. 3 may be replaced by a processor that is intended for that purpose. Through the use of a suitable selection of hardware and software, a processor that is already present for other control purposes may take on this regulation as well.

With reference of FIG. 4, the stove has a muffle with a fold-down heating element and it is heatable by additional ambient air heating and it is ventilated by an ambient air blower. The stove is equipped with a pyrolytic self-cleaner. A sensor array is disposed in the cooking chamber for detecting oven soiling values.

I claim:

1. A pyrolytic self-cleaning method for stoves, which comprises on-line optimizing a definable pyrolysis temperature range up to approximately 500° C., by:

fuzzy-controlling a transient state for a temperature starting value with a regulating device, to avoid a heating startup peak with a fuzzy control step;

recognizing subsiding of the transient state and initializing heating time which is optimized with reference to the fuzzy control step, with the regulating device;

updating, with the regulating device, a minimum heating time for the next control step on the basis of particular temperature gradient being recognized, while constantly monitoring an optimal turn-on temperature for pyrolytic oven chamber heating at a minimum heating time referred to an applicable control step; and continuously optimizing turn-off temperature with the regulating device through a closed control loop.

2. The pyrolytic self-cleaning method according to claim 1, which comprises connecting a selector circuit to a fuzzy control block, and turning the heat on and off depending on the transient state of the temperature starting value with a central control connected to the fuzzy control block.

3. The pyrolytic self-cleaning method according to claim 2, which comprises connecting a unit recognizing a temperature/time function to the central control and carrying out a recognition of the maximum stove temperature in cooperation with the unit.

4. The pyrolytic self-cleaning method according to claim 2, which comprises connecting the central control to a time counter having an output side connected to a heating timer having an output side, connecting the output side of the heating timer to the central control and optimizing the turn-off temperature upon each method step and correlating the turn-off temperature with the minimum heating time in signal interaction.

5. The pyrolytic self-cleaning method according to claim 2, which comprises providing a microprocessor as the central control.

6. The pyrolytic self-cleaning method according to claim 2, which comprises connecting an output side of the central control to an output unit, and turning on cooking chamber heating with the output unit.

7. The pyrolytic self-cleaning method according to claim 2, which comprises connecting an output side of the central control to an output unit, and turning off cooking chamber heating with the output unit.

8. The pyrolytic self-cleaning method according to claim 2, which comprises activating a display unit with the central control for signalling pyrolytic self-cleaning during the duration of the self-cleaning.

9. In a pyrolytic self-cleaning stove including at least one wall region defining an oven chamber, a muffle disposed in the at least one wall region, a heating element disposed in the at least one wall region for ambient air heating the muffle, an ambient air blower for ventilating the muffle, means associated with the muffle for pyrolytic self-cleaning, and a sensor array disposed in the cooking chamber for detecting values of oven soiling caused by operation, a device for on-line optimization of a definable pyrolysis temperature range up to approximately 500° C., comprising:

a regulating device for fuzzy-controlling a transient state for a temperature starting value, to avoid a heating startup peak with a fuzzy control step;

said regulating device recognizing subsiding of the transient state and initializing an optimized heating time referred to the fuzzy control step;

said regulating device updating a minimum heating time for the next control step on the basis of the particular temperature gradient being recognized, while constantly monitoring the optimal turn-on temperature for the pyrolytic oven chamber heating, at a minimum heating time referred to an applicable control step; and said regulating device continuously optimizing the turn-off temperature through a closed control loop.

10. The device according to claim 9, wherein said heating element can be folded away from said at least one wall region.

11. The device according to claim 9, including a selector circuit, a fuzzy control block connected to selector circuit, and a central control connected to said fuzzy control block for turning the heat on and off depending on the transient state of the temperature starting value.

12. The device according to claim 11, including a unit connected to said central control for recognizing a temperature/time function and carrying out a recognition of a maximum stove temperature in cooperation with said unit.

13. The device according to claim 11, including a time counter being connected to said central control and having an output side, a heating timer being connected to the output side of said time counter and having an output side, and the output side of said heating timer being connected to said the central control for optimizing a turn-off temperature and correlating said turn-off temperature with a minimum heating time in signal interaction.

14. The device according to claim 11, wherein said central control is a microprocessor.

15. The device according to claim 11, including an output unit connected to an output side of said central control for turning on cooking chamber heating.

16. The device according to claim 11, including an output unit connected to an output side of said central control for turning off cooking chamber heating.

17. The device according to claim 11, including a display unit being activated by said central control for signalling pyrolytic self-cleaning during the duration of the self-cleaning.

* * * * *